US007598924B2

(12) United States Patent
Hynes et al.

(10) Patent No.: US 7,598,924 B2
(45) Date of Patent: Oct. 6, 2009

(54) DISCONNECTABLE ELECTRICAL CONNECTION

(75) Inventors: Chris Hynes, Burnaby (CA); Heikki Lehtola, Tampere (FI); Youngdae Park, Coquitlam (CA); Michael Trevorrow, Delta (CA)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 12/070,994

(22) Filed: Feb. 21, 2008

(65) Prior Publication Data

US 2009/0213030 A1 Aug. 27, 2009

(51) Int. Cl.
*H01Q 1/50* (2006.01)
*H01Q 1/24* (2006.01)

(52) U.S. Cl. ..... 343/906; 343/702

(58) Field of Classification Search ..... 343/906, 343/702; 439/66, 862

See application file for complete search history.

(56) References Cited

U.S. PATENT DOCUMENTS 6,423,915 B1 * 7/2002 Winter ..... 200/292
6,512,491 B2 * 1/2003 Kanayama et al. ..... 343/883
6,943,739 B1 * 9/2005 Rousu et al. ..... 343/702
6,991,472 B2 * 1/2006 Du et al. ..... 439/66

* cited by examiner

*Primary Examiner*—Hoang V Nguyen
(74) *Attorney, Agent, or Firm*—Harrington & Smith, PC

(57) ABSTRACT

An apparatus including an antenna; a printed wiring board (PWB); and a connection system electrically connecting the antenna to the PWB. The connection system includes a first spring contact and a second spring contact. The first and second spring contacts are removably resiliently biased against each other. The first spring contact is directly connected to the antenna. The second spring contact is electrically connected to the PWB.

27 Claims, 5 Drawing Sheets

DISCONNECTABLE ELECTRICAL CONNECTION

BACKGROUND OF THE INVENTION

1. Field of the Invention

The invention relates to providing an electrical connection between two removable components of a device.

2. Brief Description of Prior Developments

It is typical for a hand-held multimedia device and other electronic devices to have a battery cover that is easy to remove. A wireless system requires an antenna with sufficient free-volume to function well. There is a trend to integrate antennas into the outer mechanics of hand-held devices. Using a battery cover antenna (such as In-Mould Labelling (IML) antenna) maximises the antenna volume and allows for thinner/smaller products. By integrating an antenna into or onto the battery cover makes designing a reliable antenna feed contact difficult. It is typically challenging to design a reliable antenna feed method for such an antenna implementation.

To make contact to the antenna feed requires a sufficiently large contact force. As illustrated in FIG. 1, making contact between this type of battery cover antenna 10 and a printed circuit board 12 is typically done using a pogo-pin contact 14 which results in an outward force 16 against the battery cover 26. Unless the battery cover is latched at the contact point 18, the antenna contact force 16 can lead to the battery cover sitting un-flush. As illustrated in FIG. 2, this is especially true for a relatively low frequency or small antenna having a feed connection from the corner (to maximize the potential bandwidth of the antenna) as illustrated by gap 20 between the corner of the main housing cover 22 and the corner 24 of the battery cover 26. The normal force 16 on the corner of the battery cover causes the corner 24 to lift-off the edge.

In another type of embodiment, the pogo-pin feed location has been placed near the centre line of the battery cover to avoid an outer edge of the battery cover sitting un-flush. However, this cannot be used very well for a relatively low frequency or small antenna which should have a feed connection from the corner of the battery cover to maximize the potential bandwidth of the antenna.

Referring also to FIG. 3, in one type of work around for the problem, an IML antenna in a battery cover 26 that is fed by a pogo-pin contact at the corner of the battery cover still produces deflection of the corner of the battery cover. However, a lip or ridge 28 was added to the mating cover 22' to hide the un-flush seating of the battery cover 26. The ridge 28 prevents debris from entering the battery compartment and also forms a cosmetic masking lip for hiding the gap 20 formation from the ordinary observer. Both of these implementations (1. placing the feed location at the centre line of the battery cover, and 2. providing a cosmetic masking lip 28) still use a feed method that utilizes a spring force 16 in a direction normal to the major plane of the battery cover. Thus, the problem of the spring contact force 16 deflecting a portion of the battery cover outward still exists.

SUMMARY OF THE INVENTION

In accordance with one aspect of the invention, an apparatus is provided including an antenna; a printed wiring board (PWB); and a connection system electrically connecting the antenna to the PWB. The connection system includes a first spring contact and a second spring contact. The first and second spring contacts are removably resiliently biased against each other. The first spring contact is connected to the antenna. The second spring contact is electrically connected to the PWB.

In accordance with another aspect of the invention, an apparatus is provided comprising a housing having a first housing section and a removable second housing section; a first electrical component in the first housing section; a second electrical component in the second housing section; and a connection system for removably electrically connecting the second electrical component with the first electrical component. The connection system comprises at least one spring contact located between the first and second housing sections with a spring contact force in a direction generally between major planes of the first and second housing sections which does not exert a substantial separation force between the first and second housing sections.

In accordance with another aspect of the invention, a battery compartment cover is provided comprising an antenna; an overmolded housing member overmolded on the antenna, wherein the housing member has a general planar shape; and an electrical spring contact connected to the housing member. The spring contact has a first end connected to the antenna and a second end extending from the housing member in a general cantilever fashion. The second end is adapted to contact another contact and exert a biasing spring contact force in a direction generally parallel to a major plane of the generally planar shaped housing member.

In accordance with another aspect of the invention, a method is provided comprising providing a first spring contact connected to a first electrical component, wherein the first electrical component is in a first housing section; providing a second spring contact connected to a second electrical component, wherein the second electrical component is in a second housing section; and removably connecting the second housing section to the first housing section, wherein the first and second spring contacts directly contact each other and removably electrically connect the first and second electrical components to each other, and wherein a contact force between the first and second spring contacts is in a direction generally between major planes of the first and second housing sections.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 4:
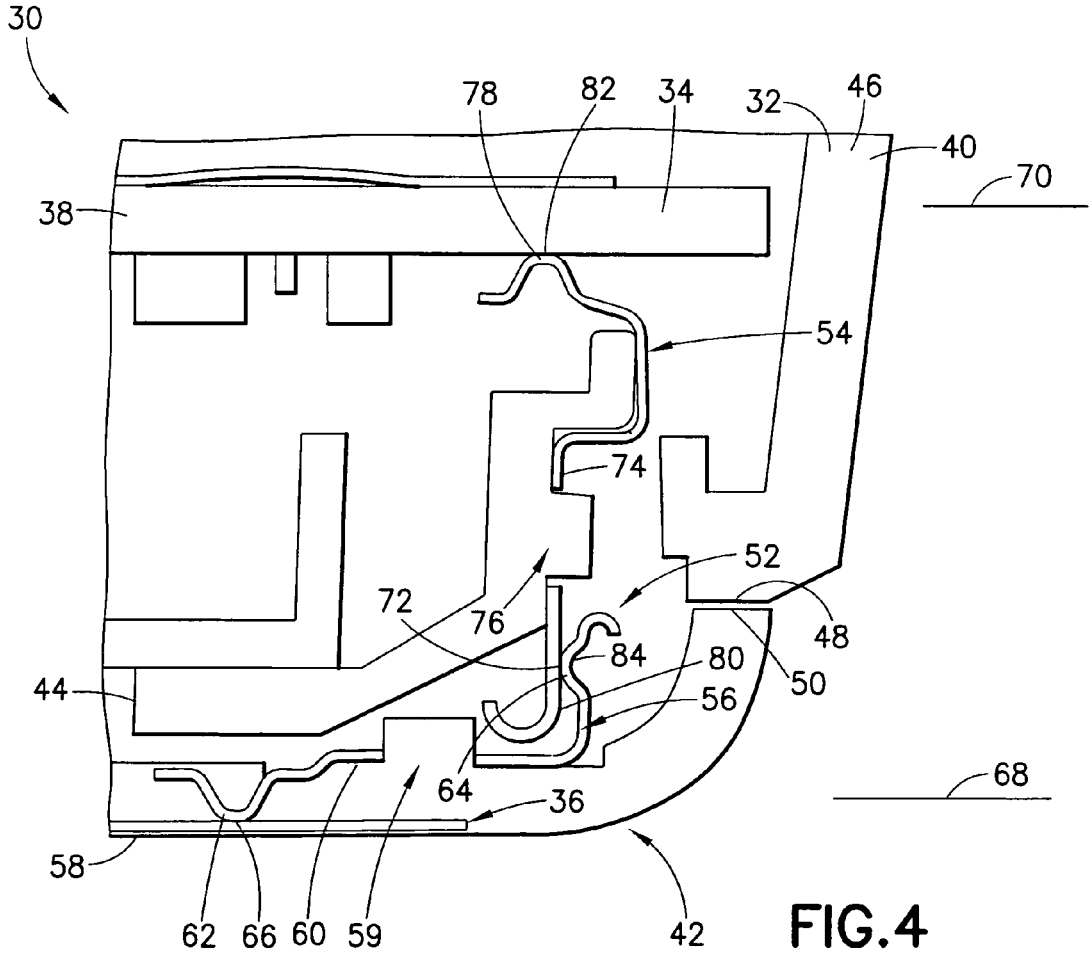
FIG. 4 is a partial cross sectional view of an apparatus comprising features of the invention.

Referring to FIG. 4, there is shown a partial cross sectional view of a hand-held portable electronic device 30 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

In this exemplary embodiment the device 30 is a multi-function portable electronic device. However, in alternate embodiments, features of the exemplary embodiment of this invention could be used in any suitable type of hand-held portable electronic device such as a mobile phone, a gaming device, a music player, or a PDA, for example. In addition, as is known in the art, the device 30 can include multiple features or applications such as a camera, a music player, a game player, or an Internet browser, for example. The device 30 generally comprises a housing 32, electronic circuitry 34 located in the housing, one or more user interfaces (not shown) on the housing (such as a keypad and/or a touch screen display for example), a battery (not shown) and an antenna 36. The electronic circuitry 34 includes a printed wiring board (PWB) 38 and a transceiver (not shown) as well as a controller (not shown) and a memory (not shown). It should be noted that in alternate embodiments, additional and/or alternative electrical components could be provided. Additionally, in alternate embodiments, the device 30 can have any suitable type of features as known in the art.

The housing 32 includes a first housing section 40 and a second housing section 42. The second housing section 42 is removable from the first housing section 40. In this embodiment the second housing section forms a battery cover. The first housing section 40 forms a battery receiving area 44 with electrical contacts for contacting terminals on the battery. The first housing section 40 includes a housing member 46 which forms a portion of the exterior of the first housing section 40 and has a flat end edge 48 which is located directly opposite a flat end edge 50 of the battery cover.

The transceiver is connected to the antenna 36 by the PWB 38 and a connection system 52. The connection system 52 includes a first spring contact 54 and a second spring contact 56. The connection system is described in further detail below.

The second housing section 42 includes the antenna 36, a housing member 58 and the second spring contact 56. The second housing section 42 can be removably connected to the first housing section 40 to capture the battery in the battery receiving area 44. The housing member 58 is preferably an overmolded housing member which has been overmolded onto the antenna 36. However, in an alternate embodiment the housing member 58 might not be an overmolded member. The second housing section has a general planar shape along a major plane 68. This major plane 68 is generally parallel to a major plane 70 of the substantially planar shape of the first housing section 40. The second housing section 42 is connected to the first housing section 40 in a general partially stacked configuration sandwiching the battery therebetween.

The second spring contact 56 has a middle section 60 which is fixedly attached to the housing member 58 at a connection location 59. In a preferred embodiment, the middle section 60 is heat staked onto the housing member 58 at the location 59. However, in an alternate embodiment any suitable type of connection could be provided.

The second spring contact 56 has a first end 62 and a second end 64. The first end 62 extends away from the connection location 59 and into a spring biased contact with the antenna 36 at location 66. However, in an alternate embodiment the first end 62 could be connected to the antenna 36 in any suitable fashion. The second end 64 of the second spring contact 56 extends away from the connection location 59 in a general cantilever fashion. More specifically, the second end 64 extends at an angle from the major plane 68. In this embodiment the angle is about 90 degrees, however it could be more or less. The second end 64 forms a resiliently deflectable contact arm for the contact 56 and has a contact surface 72.

The first spring contact 54 has a middle section 74 which is fixedly mounted to a location 76 on a housing member of the first housing section 40. In a preferred embodiment, the middle section 74 is heat staked onto the housing member at the location 76. However, in an alternate embodiment any suitable type of connection could be provided.

Figure 5:
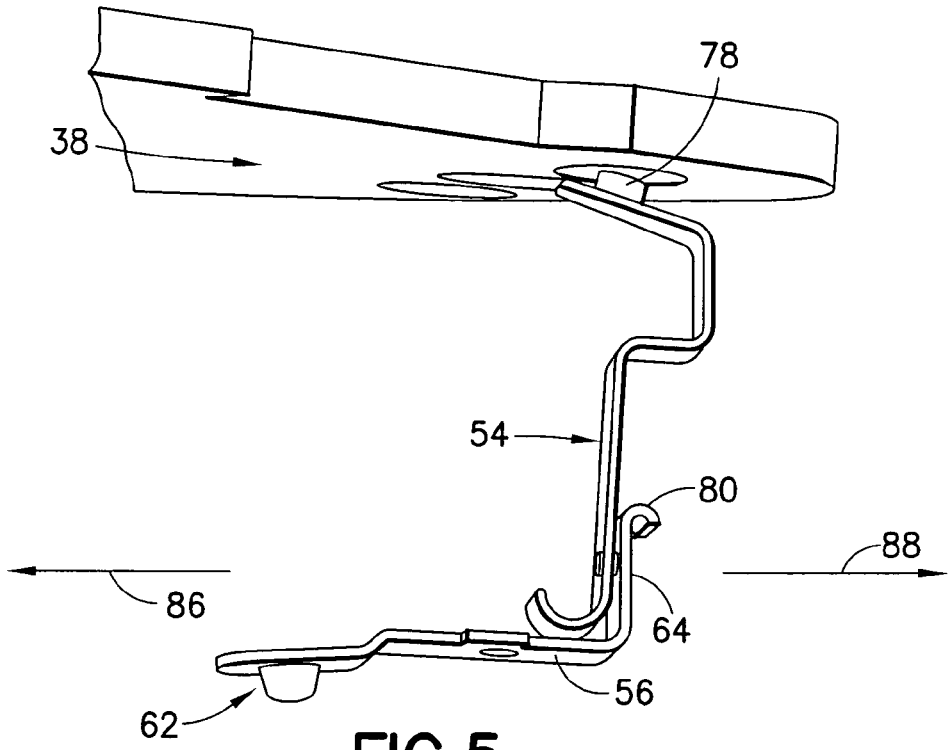
FIG. 5 is a perspective view of some of the components of the apparatus shown in FIG. 4.
Figure 6:
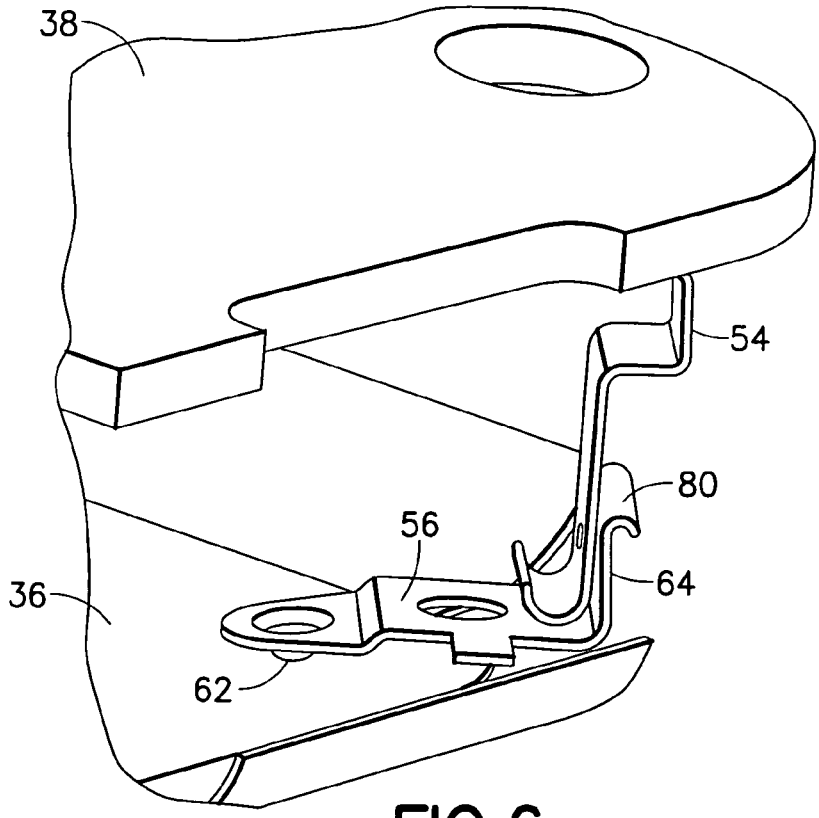
FIG. 6 is a perspective view of some of the components of the apparatus shown in FIG. 4.

Referring also to FIGS. 5 and 6, the first spring contact 54 has a first end 78 and a second end 80. The first end 78 extends away from the connection location 76 and into a spring biased electrical contact with the PWB 38 at location 82. However, in an alternate embodiment the first end 78 could be connected to the PWB 38 in any suitable fashion. The second end 80 of the first spring contact 54 extends away from the connection location 76 in a general cantilever fashion. More specifically, the second end 80 extends at an angle relative to the major plane 70. In this embodiment the angle is about 90 degrees, however it could be more or less. The second end 80 forms a resiliently deflectable contact arm for the contact 54 and has a contact surface 84.

The first spring contact 54 stays with the first housing section 40 when the second housing section 42 is removed from the first housing section 40. The second spring contact 56 stays with the second housing section 42 when the second housing section 42 is removed from the first housing section 40. When the second housing section 42 is removably connected to the first housing section 40, the second ends 64, 80 of the spring contacts 54, 56 slide against each other into a side-by-side connection as shown. The second ends 64, 80 are deflection by contact with each other as indicated by arrows 86 and 88 respectively in FIG. 5, and form a spring biased connection at the contact surfaces 72, 84.

Figure 2:
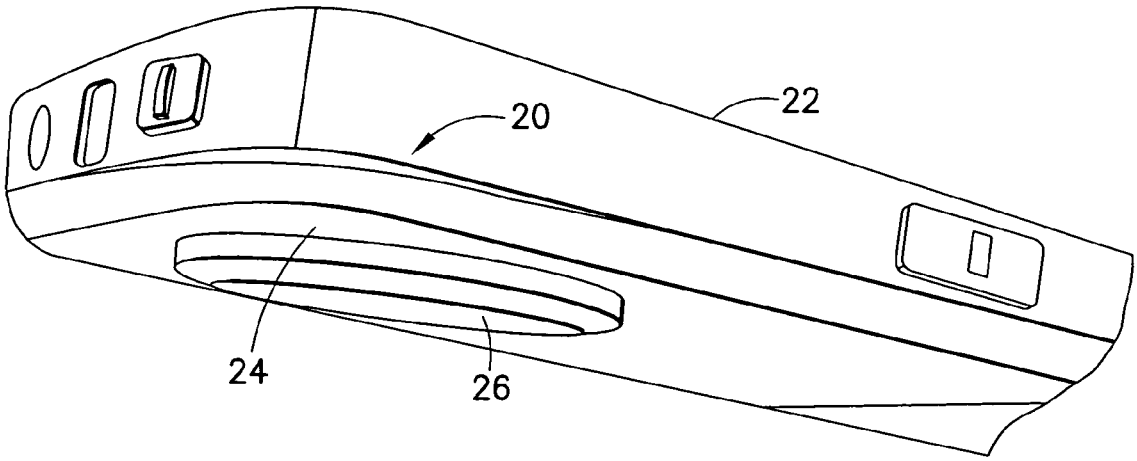
FIG. 2 PRIOR ART
FIG. 2 is a partial perspective view of a mobile telephone showing how the pogo-pin contact of FIG. 1 causes a gap to form between the battery cover and another housing section of the telephone.
Figure 3:
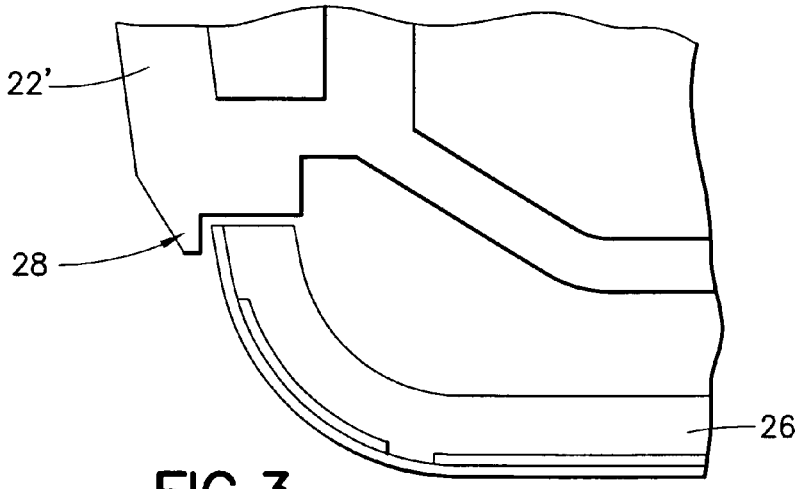
FIG.3 PRIOR ART
FIG. 3 is a partial cross sectional view showing one workaround which has been used to mask the gap illustrated in FIG. 2.

With this type of connection, the spring contact force between the second ends 64, 80 at the contact surfaces 72, 84 is in the direction of the arrows 86, 88. This is between the major planes 68, 70 and generally parallel to the major planes 68, 70. Thus, the spring contact force does not exert a substantial separation force between the first and second housing sections 40, 42 in the direction normal to the major planes 68, 70. Instead, the spring contact force is a generally tangential force or force perpendicular or substantially perpendicular to the normal direction between the major planes. With this type of spring contact arrangement, there is no tendency to lift an outer edge of the second housing section 42 away from the first housing section 40. Thus, the gap 20 (see FIG. 2), which could otherwise form an unsightly and contaminant prone opening into the battery compartment, is not formed. A cosmetic concealing and contaminant preventing ridge on the first housing member (similar to ridge 28 shown in FIG. 3) also does not need to be provided.

By using a dual-spring feed method, the battery cover antenna/PWB contact interface force can be applied in the plane tangentially to the battery cover. Thus, this can avoid an outward force against the battery cover. One spring is affixed to the battery cover antenna (by heat staking or other means) provides a static load to the antenna radiator. The other spring provides the feed path to the PWB. The interface between the two springs provides a contact point with tangential force with respect to the battery cover normal.

Advantages include the facilitation of an antenna implementation in a removal mechanical cover, and less risk to unsightly visual quality. If two contact springs are used, only a tangential directed force could be applied. So one can minimize an outward-direction normal force to avoid mating quality problems of housing pieces.

In an alternate embodiment, rather than a dual-spring connection, the connection system might comprise only one spring and a static electrical contact area on the first or second housing section.

Figure 7:
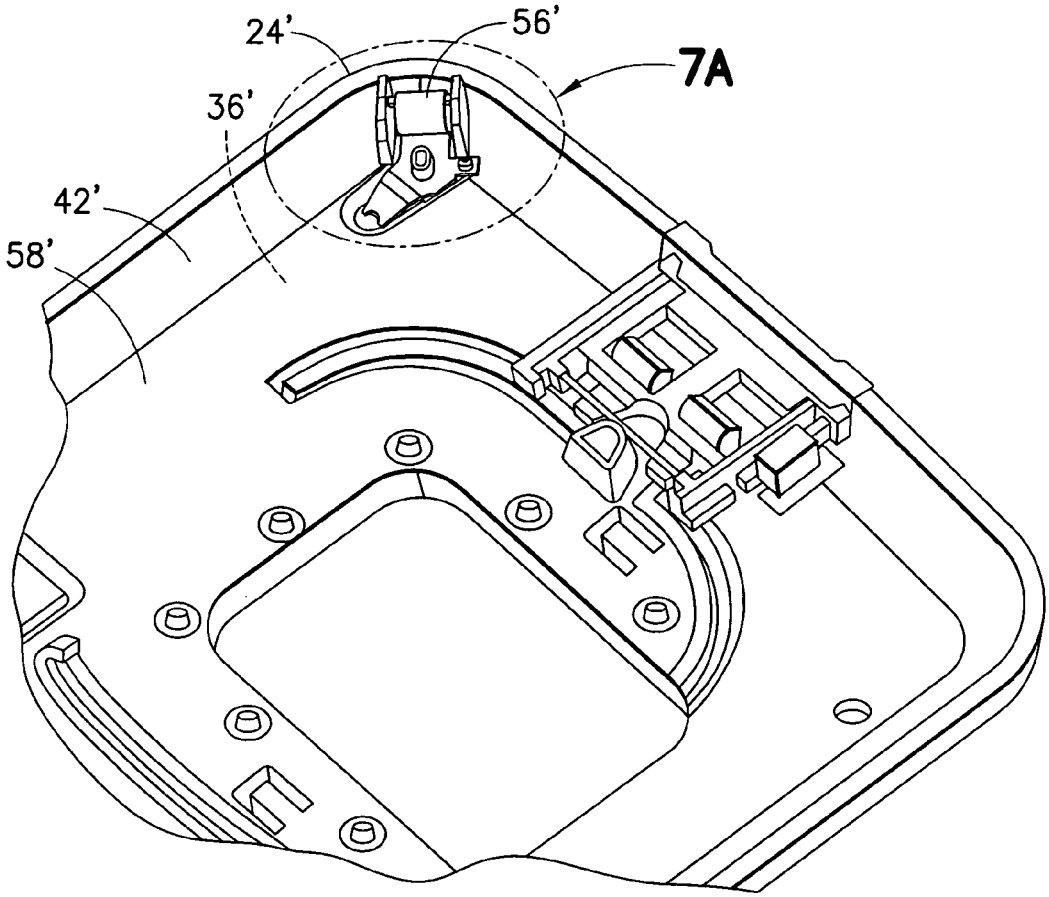
FIG. 7 is a partial perspective view of a battery cover comprising features of the invention.
Figure 7A:
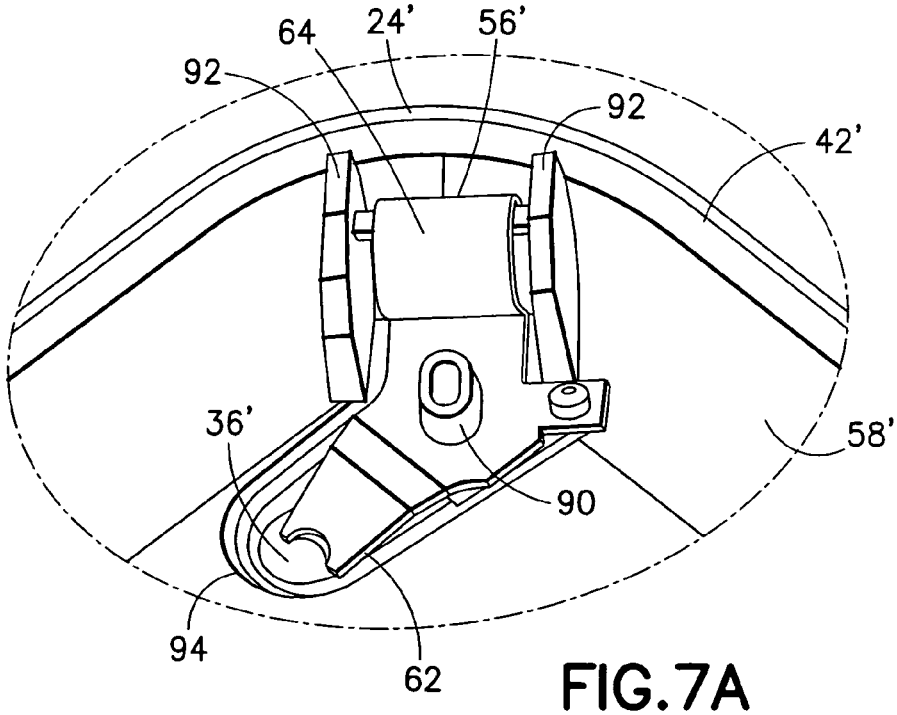
FIG. 7A is an enlarged view of a portion of the battery cover shown in FIG. 7.

Referring also to FIGS. 7 and 7A, one example showing the interior facing side of the second housing section is shown. In this embodiment the second housing section 42' comprises a housing member 58', an antenna 36' and a spring contact 56'. The housing member 58' has a contact mounting post 90 and spring contact guides 92. The guides 92 provide a containment area for the second end 64 of the spring contact 56'. The spring contact 56' has a hole in its middle section which is mounted on the post 90. The post 90 is heat deformed to heat stake the post 90 with the middle section of the spring contact. The first end of the spring contact 56' projects through a hole 94 in the housing member 58' to make a spring contact with the antenna 36'. The antenna is preferably a relatively low frequency or small antenna having a feed connection at the hole 94 in the corner 24' of the second housing section to maximize the potential bandwidth of the antenna. The housing member 58' is preferably overmolded on the antenna 36'. Even though the spring contact 56' is located in the corner 24' of the housing section 42', the force exerted on the spring contact 56' by the mating contact 54 (not shown) is not normal to the major plane of the housing section and, therefore, does not exert a substantial separation force on the second housing section 42' in the normal direction when the second housing section 42' is connected to the first housing section. Therefore, no gap 20 is formed and no ridge 28 is needed. However, the first end 62 (because the contact 56 is fixedly attached to post 90) can still provide a sufficiently large spring contact force directly against the antenna 36'.

Figure 1:
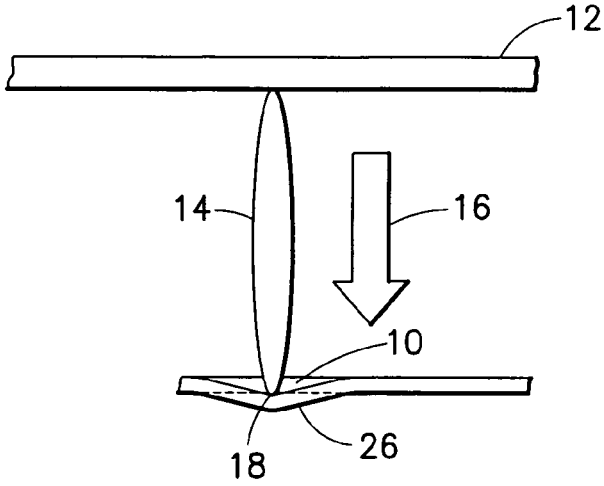
FIG. 1 PRIOR ART
FIG. 1 is a diagram illustrating a conventional pogo-pin contact used to connect an antenna in a battery cover to a printed circuit board.
Figure 8:
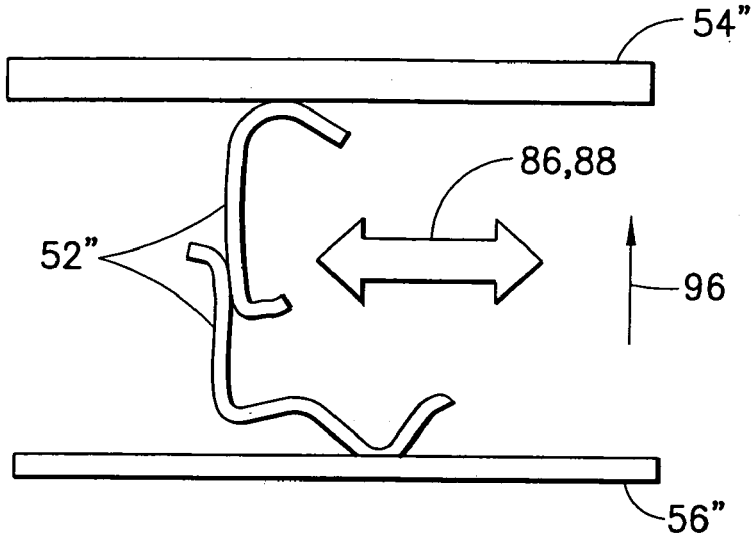
FIG. 8 is an illustration of features of the invention.

Referring also to FIG. 8, a more generic illustration of the invention is shown. The main features of the invention is that the second housing section 56" having an electrical component (such as an antenna for example) can be connected to a first housing section 54" having another electrical component (such as a printed wiring board for example) at feast partially in a direction 96. However, the connection system 52" (such as having a first spring contact on the first housing section 54" and a second spring contact on the second housing section 56") can removably electrically connect the housing sections to each other by providing a contact force direction 86, 88 which is parallel (or at least not normal to) the major plane of the second housing section 56". With a generally planar shaped second housing section (such as a battery cover of a mobile telephone for example), a force applied in a direction normal to the major plane of the second housing section 56" is the most likely to cause deformation and deflection of a portion of the second housing section 56" out of that plane. Thus, because the spring contact force 86, 88 is not normal to the major plane of the battery cover as in the prior art shown in FIGS. 1-3, with the invention outward deflection of a portion of the second housing section reverse to direction 96 is not inclined to happen.

Figure 9:
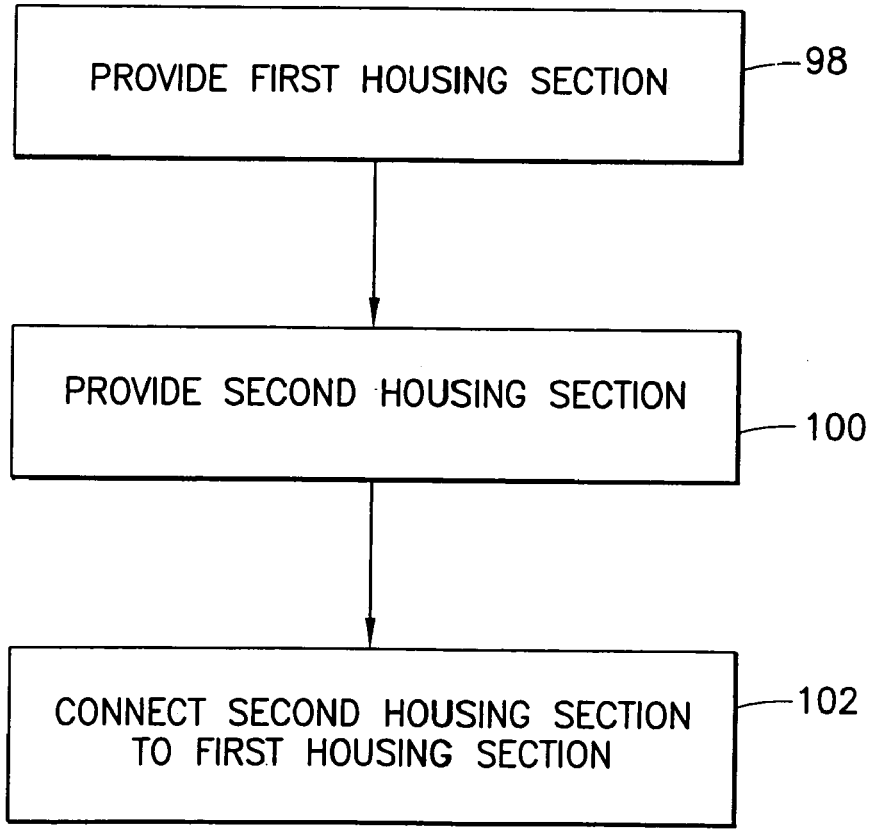
FIG. 9 is a diagram illustrating steps of one method of the invention.

Referring also to FIG. 9, with the invention one method of the invention can comprise providing a first housing section including a first spring contact connected to a first electrical component as indicated by block 98. The method can further comprise providing a second housing section including a second spring contact connected to a second electrical component as indicated by block 100. As indicated by block 102 the method can further comprise removably connecting the second housing section to the first housing section, wherein the first and second spring contacts directly contact each other and removably electrically connect the first and second electrical components to each other, and wherein a contact force between the first and second spring contacts is in a direction generally between major planes of the first and second housing sections.

An antenna requires certain amount of space to work reliably and, as mobile devices are tending to become smaller and smaller, this creates problems for antenna placement. One way to address antenna place for use in a mobile device is to have antenna placement into the battery cover of the device. Connection between the antenna and rest of the device has to be then be made by a separate connector. Current solutions use a pogo-pin connection to the battery cover. The invention, on the other hand, presents a different way to do the connection by using two spring contacts for connection. The first contact is attached to the antenna and second contact is attached to the PWB or other required element. The spring contacts are placed so that the connection and tension between the spring contacts is directed either sideways or lengthwise when compared to the device.

Current solutions target force against a battery cover to guarantee that antenna contact is kept all the time. However, this causes the housing gap problem noted above. This large normal force and resulting gap problem has to be compensated by a different kinds of mechanical arrangements to keep the battery cover closed. The invention, on the other hand, moves the antenna connection force to a new direction to prevent the battery cover from being pushed away from the rest of the device and, therefore, the battery cover is easier to secure in the place. A novel feature in the invention is an electrical connection between a battery cover antenna and the rest of the device by two spring contacts.

In the preferred embodiment, a connection system electrically is provided connecting the antenna to the PWB, wherein the connection system comprises a first spring contact and a second spring contact, wherein the first and second spring contacts are removably resiliently biased against each other, wherein the first spring contact is directly connected to the antenna, and wherein the second spring contact is electrically connected to the PWB. However, in an alternate embodiment the first spring contact is indirectly connected to the antenna, such as when one or more intermediate electrically conductive member(s) are located between the first spring contact and the antenna.

It should be understood that the foregoing description is only illustrative of the invention. Various alternatives and modifications can be devised by those skilled in the art without departing from the invention. For example, features recited in the various dependent claims could be combined with each other in any suitable combination(s). Accordingly, the invention is intended to embrace all such alternatives, modifications and variances which fall within the scope of the appended claims.

What is claimed is:

1. An apparatus comprising:

an antenna;

a printed wiring board (PWB); and a connection system electrically connecting the antenna to the PWB, wherein the connection system comprises a first spring contact and a second spring contact, wherein the first and second spring contacts are removably resiliently biased against each other, wherein the first spring contact is connected to the antenna, and wherein the second spring contact is electrically connected to the PWB.

2. An apparatus as in claim 1 wherein the first spring contact comprises a first end which is in a spring biased contact with the antenna.

3. An apparatus as in claim 2 wherein the second spring contact comprises a first end which is in a spring biased contact with the PWB.

4. An apparatus as in claim 1 wherein the second spring contact comprises a first end which is in a spring biased contact with the PWB.

5. An apparatus as in claim 1 wherein first and second spring contacts comprise second ends which extend generally towards each other and are located in a side-by-side contact.

6. An apparatus as in claim 1 wherein the antenna and the PWB are located generally parallel to each other, wherein the first and second spring contacts each have a second end contacting each other, and wherein the second ends extend away from the antenna and the PWB, and towards each other, in general reverse opposite directions.

7. An apparatus as in claim 1 wherein the antenna and the PWB are located generally parallel to each other, and wherein the first and second spring contacts exert a biasing force against each other in a plane which is spaced from and between the antenna and the PWB.

8. An apparatus as in claim 1 further comprising a housing including a first housing section and a removable second housing section, wherein the first housing section has the PWB therein, wherein the first spring contact has a second end which extends out of the first housing section in a general cantilever fashion into an area adapted to be covered by the second housing section.

9. An apparatus as in claim 8 wherein the second spring contact is connected to the second housing section and has a second end which extends from the second housing section in a general cantilever fashion.

10. An apparatus as in claim 9 wherein the second ends of the first and second spring contacts exert opposite spring contact forces against each other in directions generally between major planes of the first and second housing sections, wherein the spring contact forces do not exert a substantial separation force between the first and second housing sections.

11. An apparatus as in claim 10 wherein the antenna and the PWB are located generally parallel to each other, and wherein the opposite spring contact forces do not exert a substantial separation force to push the antenna and the PWB apart in a direction generally perpendicular to the antenna and the PWB.

12. An apparatus as in claim 1 wherein the first spring contact is in a first housing section, wherein the second spring contact is in a second housing section removably connected to the first housing section in a general partially stacked configuration, and wherein the first and second spring contacts exert a biasing spring force against each other in a direction which does not push the stacked configuration apart.

13. An apparatus as in claim 12 wherein the second housing section comprises a battery cover adapted to retain a battery with the first housing section.

14. An apparatus as in claim 13 wherein the battery cover comprises a housing member overmolded onto the antenna.

15. An apparatus as in claim 14 wherein the second spring contact is heat staked onto the housing member.

16. An apparatus as in claim 1 wherein the first spring contact is directly connected to the antenna.

17. An apparatus comprising:

a housing having a first housing section and a removable second housing section;

a first electrical component in the first housing section;

a second electrical component in the second housing section, wherein the second housing section comprises a removable battery cover; and a connection system for removably electrically connecting the second electrical component with the first electrical component, wherein the connection system comprises at least one spring contact located between the first and second housing sections with a spring contact force in a direction generally between major planes of the first and second housing sections which does not exert a substantial separation force between the first and second housing sections.

18. An apparatus as in claim 17 wherein the second electrical component comprises an antenna.

19. An apparatus as in claim 18 wherein the removable battery cover comprises an overmolded housing member which is overmolded onto the antenna.

20. An apparatus as in claim 17 wherein the at least one spring contact comprises two spring contacts, wherein a first one of the spring contacts extends from the first electrical component in a general perpendicular direction, wherein a second one of the spring contacts extends from the second electrical component in a generally perpendicular direction, and wherein second ends of each of the first and second spring contacts are in a general side-by-side contacting position.

21. An apparatus as in claim 20 wherein the first spring contact comprises a first end which is in a spring biased contact with the first electrical component.

22. An apparatus as in claim 21 wherein the second spring contact comprises a first end which is in a spring biased contact with the second electrical component.

23. An apparatus as in claim 17 wherein the first and second electrical components have generally parallel planar shapes, and wherein the direction of the spring contact force is located between the first and second electrical components and does not intersect the first or second electrical components.

24. An apparatus as in claim 17 wherein the second housing section has a generally planar shape connected to the first housing section in a general partially stacked configuration at a receiving area of the first housing section.

25. An apparatus as in claim 17 wherein the connection system comprises means for substantially preventing the connection system from exerting the substantial separation force between the first and second housing sections.

26. A battery compartment cover comprising:

an antenna;

an overmolded housing member overmolded on the antenna, wherein the housing member has a general planar shape; and an electrical spring contact connected to the housing member, wherein the spring contact has a first end connected to the antenna and a second end extending from the housing member in a general cantilever fashion, wherein the second end is adapted to contact another contact and exert a biasing spring contact force in a direction generally parallel to a major plane of the generally planar shaped housing member.

27. A method comprising:

providing a first spring contact connected to a first electrical component, wherein the first electrical component is in a first housing section;

providing a second spring contact connected to a second electrical component, wherein the second electrical component is in a second housing section; and removably connecting the second housing section to the first housing section, wherein the first and second spring contacts directly contact each other and removably electrically connect the first and second electrical components to each other, and wherein a contact force between the first and second spring contacts is in a direction generally between major planes of the first and second housing sections.

* * * * *